United States Patent [19]

Cameron et al.

[11] Patent Number: 4,766,408

[45] Date of Patent: Aug. 23, 1988

[54] CURRENT LIMITING FUSE WITH INDICATOR

[75] Inventors: Frank L. Cameron; George A. Smith, both of N. Huntingdon, Pa.

[73] Assignee: Westinghouse Electric Corp., Pittsburgh, Pa.

[21] Appl. No.: 92,965

[22] Filed: Sep. 3, 1987

[51] Int. Cl.[4] ..... H01H 85/30

[52] U.S. Cl. ..... 337/244; 337/267

[58] Field of Search ..... 337/244, 267, 241, 265

[56] References Cited

U.S. PATENT DOCUMENTS

| | | | |
|---|---|---|---|
| 3,832,665 | 8/1974 | Belcher | 337/244 |
| 3,959,617 | 5/1976 | Hults | 200/305 |
| 4,001,749 | 1/1977 | Kozacka | 337/244 |
| 4,156,225 | 5/1979 | Cuzzone | 337/241 |
| 4,387,358 | 6/1983 | Knapp, Jr. | 337/244 |
| 4,617,544 | 10/1986 | Mooz et al. | 337/244 |

*Primary Examiner*—H. Broome

*Attorney, Agent, or Firm*—L. P. Johns

[57] ABSTRACT

A current limiting fuse with an indicator characterized by a generally tubular, electrically insulating casing having a pair of tubular terminal members at opposite ends of the casing. A fusible element extends between the terminal members and through the casing. An indicator plunger extends from one end terminal member and is movable between a retracted and extended positions and is biased in the extended position. A restraining wire extending between the other end terminal member and the indicator plunger. The wire having a smaller diameter portion in the casing. An electrically conductive grease disposed between the plunger and the tubular terminal member.

5 Claims, 1 Drawing Sheet

CURRENT LIMITING FUSE WITH INDICATOR

BACKGROUND OF THE INVENTION

1. Field of the Invention:

This invention relates to current limiting fuses and, more particularly, to fuses as having indicator means for denoting a fuse condition.

2. Description of the Prior Art:

One type of current limiting fuse comprises a cylindrical housing of insulating material having opposite ends closed by a metal cap or ferrule. At least one fusible element extends through the housing and between the caps. During normal current conditions, the fusible elements remain in tact. When current through the fuse element exceeds the current rating of the fuse for a sufficient time, the element melts and usually forms an arc, for which reason the housing is filled with an arc-extinguishing material such as sand.

Aside from the fact that a fuse no longer functions after the fuse elements melt, there is normally no obvious change in the outward appearance of the fuse. For that reason, fuses that are currently in use are provided with an indicator by which it is readily evident that the fuse has melted, or fused. Some examples of fuses having indicators are disclosed in U.S. Pat. Nos. 3,636,491, 3,848,445, 3,911,385, 4,058,784, and 4,060,786. The indicators are normally retained in a retracted position by a restraining wire which, like the fuse elements, extends throughout the length of the casing and is in electrical contact with the terminals at opposite ends thereof.

Under normal operating conditions of the fuse, the indicator wire does not conduct a significant current because it has a higher coefficient of electrical resistance than the fuse elements. Only after the fuse elements have melted, or fused, does the restraining wire conduct current momentarily until it likewise melts or fuses, at which time the indicator is no longer retracted out of position and is extended to an indicating position. With some fuses, however, the gauge of the restraining wire must be sufficiently large for fabrication and connection with an indicator, and at the same time small enough to melt in a minimal required time.

In addition, it is necessary during assembly of the indicator that electrical contact is maintained between the several parts to assure a closed circuit through the restraining wire when the wire is bearing the load after the fuse elements have melted.

SUMMARY OF THE INVENTION

It has been found in accordance with this invention that problems incurred in some prior art structures may be overcome by providing a current limiting fuse comprising a generally tubular, electrically insulating casing; terminal means disposed adjacent to each of the opposite ends of the casing, one of the terminal means including an opening at one of the axial ends of the fuse; a fusible element disposed in the casing and conductively interconnected with the terminal means; the terminal means at one end of the casing including a terminal stud and an indicator plunger which plunger is movably mounted on the stud between extended and retracted positions and being biased in one of said positions; a restraining wire connected between the indicator plunger and the other of the terminal means for normally retaining the plunger in the retracted position, the wire having a lower coefficient of electrical conductivity than the fusible element; an electrically conductive grease between the stud and indicator to maintain an electrically conductive path therebetween; the stud being tubular, slidably mounted within the stud and biased in the extended position, the plunger being tubular and having a pin extending laterally of and within the plunger, the pin having opposite ends proximate to the surface of the stud, the conductive grease disposed on the opposite ends of the pin for providing an electrically conductive path between the stud and the plunger, the retaining wire being connected to the pin within the plunger, the retaining wire having a smaller cross-section within the casing than within the stud, and the casing being filled with an arc-quenching material.

The advantage of the device of this invention is that it includes utilization of a conducting grease which lubricates, seals, and facilitates arc transfer, and at the same time uses a stepped retaining wire that assures proper indicator operation.

DESCRIPTION OF THE PREFERRED EMBODIMENT

Figure 1:
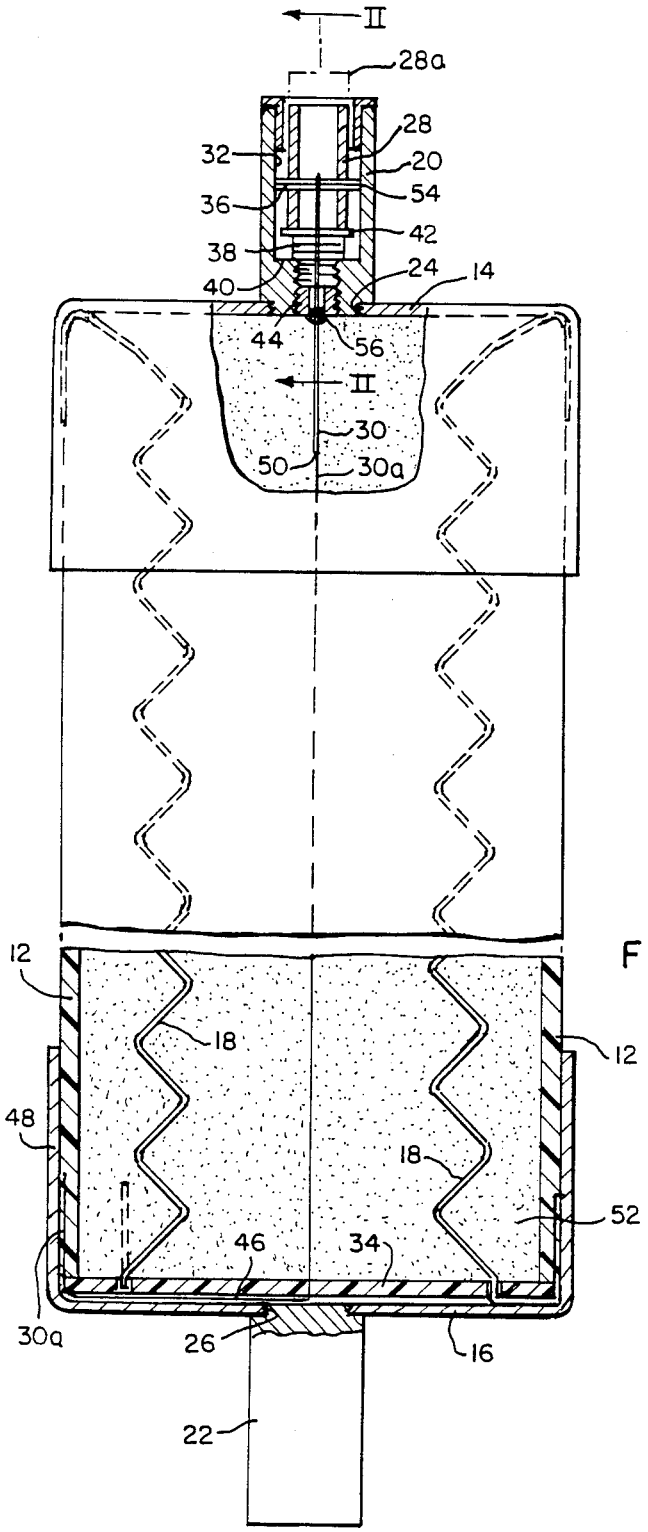
FIG. 1 is a sectional view of a current limiting fuse, partly in elevation, with an indicating mechanism in accordance with this invention.
Figure 2:
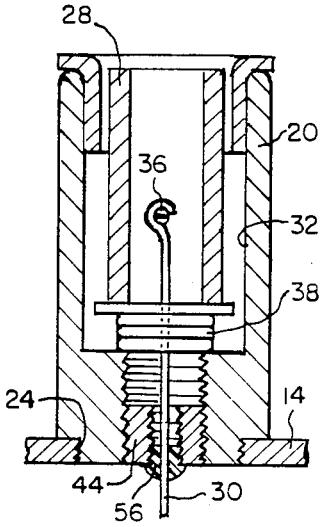
FIG. 2 is a fragmentary sectional view taken on the line 2—2 of FIG. 1.

A current limiting fuse structure is generally indicated at 10 in FIG. 1 and includes a housing or casing 12, terminal end caps for electrically conducting ferrules 14, 16, and a plurality of fusible elements 18 extending through the casing and between the ferrules. The casing 12 is tubular, such as a cylindrical, and is formed from a suitable electrically insulating material, such as a glassfibre reinforced melamine, and having a diameter of up to four inches and a length of about twenty-four inches.

The ferrules 14, 16, being composed of an electrically conductive material, such as copper, serve as enclosures for the casing 12 as well as being terminal means for opposite ends of the several fusible elements 18, the ends of which are disposed between the ends of the casing 12 and the respective ferrules in a conventional manner. The ferrules 14, 16 will be secured to the casing by a suitable bonding such as crimping, or adhesive material, such as an epoxy cement, in a conventional manner.

As shown in FIG. 1 terminals 20, 22 are provided as coaxial projections on the ferrules 14, 16, respectively. The terminals 20, 22 may be integral with the corresponding ferrules 14, 16, or they may be attached in a suitable manner to each ferrule, such as by threaded joints 24, 26. During normal operation of the fuse, a circuit through the fuse structure 10 extends from the terminal 20, through the ferrule 14, the fuse elements 18, the ferrule 16, and the terminal 22.

When an overload condition occurs in the fuse, the fuse elements 18 melt or fuse. To provide an indication of the interrupting operation of the fuse, an indicating means is provided which includes a body or plunger 28 and a retaining wire 30. The terminal 20 is a tubular member having a bore 32 in which the plunger 28 is disposed in a retracted position during normal operation of the fuse structure 10. The retaining wire 30 extends between a support element 34, adjacent to the ferrule 16, and a pin 36 in the plunger 28. Thus the retaining wire 30 retains the plunger 28 within the bore 32 of the terminal 20 against the pressure of a coil spring 38 disposed within the bore 32 and between a shoulder 40 of the bore and a washer 42 at the lower end of the plunger 28. The wire 30 is maintained in alignment by passing through a bore in a dielectric plug 44. A portion 46 at the lower end of the wire 30 extends from the support element 34 to a location between the casing 12 and a cylindrical flange 48 of the metallic ferrule 16.

In accordance with this invention, the retainer wire 30 is a stepped wire. That is, the wire 30 has a larger gauge or diameter extending between the pin 36 and a junction 50 than the diameter or gauge of the wire portion **30*a* below the junction 50 and the support element 34. The junction 50 involves a metallurgical bond between the upper and lower portions thereof and a lower portion 30*a* has a diameter of about 0.010 inch. In this manner, the smaller diameter portion 30*a* of the wire 30 burns or fuses within a body of arc-extinguishing material 52, such as sand, which occupies the interior of the casing 12 and surrounds the fusible elements 18 as well as the retaining wire 30. Accordingly, during the brief moment after the fusible elements 18 have melted, when the retaining wire 30 is sustaining a current between the ferrules 14, 16, a path of current extends between the parts 20, 36, 30, 48, and 22**.

Also, in accordance with this invention a layer 54 of electrically conductive grease is disposed on and around the end portions of the pin 36 as well as in contact with the surface of the bore 32 of the terminal 20. A mass of grease 56 of electrically conductive material, such as dimethacylate, is also disposed over the end of the hole in the plug 44 to prevent sand 52 from entering the hole. The mass of grease 56 likewise functions to serve as a current path between the wire 30 and the lower end of the terminal 20 below the plug 44.

Accordingly, when the retaining wire 30 fuses or melts, the plunger 28 moves axially outwardly from the retracted position, shown in FIG. 1, under the influence of a coil spring 38 to an extended position **28*a* where it is visible, whereby indicating that the fuse elements 18** have melted or fused.

In conclusion, the fuse indicator operates to reveal that the current limiting fuse has melted. The significant points of novelty include the utilization of a conducting grease which lubricates, seals, and facilitates arc transfer, and the use of a stepped-wire element to assure proper indicator operation.

What is claimed is:

1. A current limiting fuse with indicator comprising a generally tubular, electrically insulating casing;

terminal means disposed adjacent to each of the opposite ends of the casing, one of the terminal means including an opening at one of the axial ends of the fuse;

a fusible element disposed in the casing and conductively interconnected with the terminal means;

the terminal means at one end of the casing including a terminal stud and an indicator plunger which plunger is movably mounted on the stud between extended and retracted positions and being biased in one of said positions;

a restraining wire connected between the indicator plunger and the other of the terminal means for normally retaining the plunger in the retracted position, the wire having a lower coefficient of electrical conductivity than the fusible element; and an electrically conductive grease between the stud and indicator to maintain an electrically conductive path therebetween.

2. The fuse of claim 1 in which the stud is tubular, the plunger is slidably mounted within the stud and is biased in the extended position.

3. The fuse of claim 2 in which the plunger is tubular and includes a pin extending laterally of and within the plunger, the pin having opposite ends proximate to the surface of the stud, the conductive grease disposed on the opposite ends for providing an electrically conductive path between the stud and the plunger and the retaining wire being connected to the pin within the plunger.

4. The fuse of claim 3 in which the plunger is tubular and includes a pin extending laterally of and within the plunger the pin having opposite ends proximate to the surface of the stud and a conductive grease disposed on the opposite ends for providing an electrically conductive path between the stud and the plunger.

5. The fuse of claim 4 in which the casing is filled with arc-quenching material.

* * * * *